US010788030B2

(12) United States Patent
Prins

(10) Patent No.: US 10,788,030 B2
(45) Date of Patent: Sep. 29, 2020

(54) METHOD OF CONTROL OF COMPRESSORS WITH MORE THAN TWO CAPACITY STATES

(71) Applicant: DANFOSS A/S, Nordborg (DK)

(72) Inventor: Jan Prins, Nordborg (DK)

(73) Assignee: Danfoss A/S, Nordborg (DK)

( * ) Notice: Subject to any disclaimer, the term of this patent is extended or adjusted under 35 U.S.C. 154(b) by 241 days.

(21) Appl. No.: 14/910,291

(22) PCT Filed: Feb. 7, 2014

(86) PCT No.: PCT/EP2014/052442

§ 371 (c)(1),
(2) Date: Feb. 5, 2016

(87) PCT Pub. No.: WO2015/039765

PCT Pub. Date: Mar. 26, 2015

(65) Prior Publication Data

US 2016/0177938 A1 Jun. 23, 2016

(30) Foreign Application Priority Data

Sep. 23, 2013 (EP) ..... 13185552

(51) Int. Cl.
*F04B 49/03* (2006.01)
*F04B 27/00* (2006.01)
(Continued)

(52) U.S. Cl.
CPC ..... *F04B 49/03* (2013.01); *F04B 27/005* (2013.01); *F04B 39/08* (2013.01); *F04B 49/02* (2013.01);
(Continued)

(58) Field of Classification Search
CPC ..... F04B 27/005; F04B 39/08; F04B 49/02; F04B 49/03; F04B 49/16; F04B 49/22; F04B 49/225
(Continued)

(56) References Cited

U.S. PATENT DOCUMENTS 3,692,434 A * 9/1972 Schnear ..... F04B 27/053 417/266
4,494,382 A * 1/1985 Raymond ..... F25B 5/00 417/280
(Continued)

FOREIGN PATENT DOCUMENTS

CN 101772643 A 7/2010
DE 3500636 A1 7/1985
(Continued)

OTHER PUBLICATIONS

International Search Report for PCT Serial No. PCT/EP2014/052442 dated May 12, 2014.
(Continued)

*Primary Examiner* — Connor J Tremarche
(74) *Attorney, Agent, or Firm* — McCormick, Paulding & Huber PLLC

(57) ABSTRACT

A method of operating a reciprocating compressor for a vapour compression system is disclosed. The reciprocating compressor comprises at least two cylinders and at least two unloaders, each unloader can be operated in an idle mode or in an active mode and therefore the reciprocating compressor can run in more than two capacity states. The capacity states alternates periodically between states in such a way that a substantially continuous range of effective capacities can be obtained while the individual cylinders are evenly loaded.

21 Claims, 2 Drawing Sheets

(51) Int. Cl.
*F04B 49/02* (2006.01)
*F04B 39/08* (2006.01)
*F04B 49/16* (2006.01)
*F04B 49/22* (2006.01)

(52) U.S. Cl.
CPC ..... *F04B 49/16* (2013.01); *F04B 49/22* (2013.01); *F04B 49/225* (2013.01)

(58) Field of Classification Search
USPC ..... 417/53
See application file for complete search history.

(56) References Cited

U.S. PATENT DOCUMENTS 4,506,516 A * 3/1985 Lord ..... F04B 49/02 219/486
4,506,517 A 3/1985 Pandzik
2004/0016251 A1* 1/2004 Street ..... F25B 49/02 62/209
2008/0308069 A1* 12/2008 Kolmanovsky ..... F02D 13/0226 123/472
2011/0129361 A1 6/2011 Sato
2012/0192583 A1* 8/2012 Lifson ..... F04B 39/08 62/228.5
2013/0139535 A1 6/2013 Nares et al.

FOREIGN PATENT DOCUMENTS

EP 2623901 A1 8/2013
WO 2011/011221 A2 1/2011

OTHER PUBLICATIONS

Indian Examination Report for Serial No. 201617000992 dated Jan. 17, 2019.

* cited by examiner

METHOD OF CONTROL OF COMPRESSORS WITH MORE THAN TWO CAPACITY STATES

CROSS-REFERENCE TO RELATED APPLICATIONS

This application is entitled to the benefit of and incorporates by reference subject matter disclosed in the International Patent Application No. PCT/EP2014/052442 filed on Feb. 7, 2014 and European Patent Application No. 13185552 filed on Sep. 23, 2013.

TECHNICAL FIELD

The present invention relates to a method of operating a reciprocating compressor comprising at least two cylinders, at least two unloaders and more than two capacity states in a vapour compression system, such as refrigeration systems, air conditioning systems or heat pumps.

BACKGROUND

When controlling a vapour compression system, such as a refrigeration system, an air condition system or heat pumps, a reciprocating compressor with at least two unloaders can be used.

In a reciprocating compressor with at least two unloaders each unloader can be operated individually so each cylinder that is operated by this unloader is compressing gas independent of the other cylinders, thereby one or more cylinders can be active, i.e. compressing gas, while remaining cylinders are idle, i.e. not compressing gas.

Using a reciprocating compressor with at least two unloaders it is a problem that wear on the moving parts of the compressor can be unevenly distributed because the cylinders are unevenly loaded and oil can be collected in cylinders that run too long in idle mode.

US 2013/0139535 A1 discloses a variable-capacity compressor that includes a plurality of compressor elements contained in a housing between an inlet and an outlet. The variable-capacity compressor includes a valve having an electrical control. The valve is dedicated to fewer than all of the compressing elements. The valve is movable between a first state which communicates refrigerant flow to the compressing elements, and a second state that reduces or stops flow the compressing elements. An unloading controller may have an operational modulation mode that includes cycling a valve between on and off states to provide a portion of compressor capacity.

WO 2011/011221 A2 discloses a reciprocating compressor including a first cylinder and a second cylinder, first and second suction cutoff unloader valve assemblies, and a controller. The first and second suction cutoff unloader valve assemblies are capable of a rapid cycling to interrupt flow of refrigerant to the first and second cylinders.

SUMMARY

It is an object of embodiments of the invention to provide a method of operating a reciprocating compressor with more than two unloaders in such a way that the cylinders will be even loaded.

The invention provides a method of operating a reciprocating compressor defining two or more capacity levels, the reciprocating compressor comprising at least two cylinders and at least two unloaders, each unloader being capable of operating at least one of the cylinders to be in an idle mode or in an active mode, wherein at least some of the capacity levels of the reciprocating compressor are obtainable by two or more setting combinations of the unloaders, the method comprising the steps of:

- selecting an effective capacity to be delivered by the reciprocating compressor,
- selecting a first sequence of capacity levels of the reciprocating compressor, said first sequence providing the selected effective capacity,
- for each of the capacity levels being used in the first sequence, selecting a second sequence of setting combinations of the unloaders which obtain the capacity level, at least one of said second sequences comprising two or more different setting combinations,
- defining a final sequence of setting combinations of the unloaders, based on the first sequence of capacity levels and each of the second sequences of setting combinations of the unloaders, in such a manner that:
  - the capacity levels provided by the setting combinations of the final sequence provides the capacity levels of the first sequence of capacity levels, and
  - for each of the capacity levels, the final sequence provides the setting combinations of the corresponding second sequence of setting combinations of the unloaders, and
- operating the reciprocating compressor in accordance with the final sequence.

The present invention relates to a method for operating a reciprocating compressor. In the present context the term 'reciprocating compressor' should be interpreted to mean a positive-displacement compressor that uses pistons to deliver gas at high pressure.

The reciprocating compressor defines two or more capacity levels. This should be interpreted to mean that the compressor is capable of delivering compressed refrigerant at two or more discrete capacity levels. It should be noted that, effectively, other capacity levels may be delivered by switching between the discrete capacity levels.

The reciprocating compressor comprises at least two cylinders and at least two unloaders. Each unloader is capable of operating at least one of the cylinders to be in an idle mode or in an active mode. When a cylinder is in an active mode, it compresses refrigerant, and when a cylinder is in an idle mode, the corresponding unloader prevents the cylinder from compressing refrigerant. Accordingly, when all of the cylinders are in an active mode, the compressor operates at maximum capacity. When all of the cylinders are in an idle mode, the compressor operates at zero capacity, i.e. it is effectively not compressing gas. When some of the cylinders are in an active mode and some of the cylinders are in an idle mode, the compressor operates at a discrete capacity level, which is higher than zero and lower than the maximum capacity. In this case the discrete capacity level is determined by the number of cylinders which operate in an active mode. For instance, if the compressor comprises three cylinders, and two of them are in an active mode, and the last one is in an idle mode, then the compressor operates at a discrete capacity level which is ⅔ of the maximum capacity.

At least some of the capacity levels of the reciprocating compressor are obtainable by two or more setting combinations of the unloaders. Since the unloaders determine whether the cylinders are in an active mode or in an idle mode, a given discrete capacity level can be obtained by selecting an appropriate combination of settings of the unloaders. For instance, if the compressor comprises three cylinders, each having a corresponding unloader, and it is desirable to obtain a capacity level which is ⅓ of the maximum capacity, then one of the cylinders must be in an active mode, while the other two cylinders must be in an idle mode. Accordingly, this capacity level can be obtained by selecting a combination of settings of the unloaders which ensures that one unloader operates its corresponding cylinder to be in an active mode, and two of the unloaders operate their corresponding cylinders to be in an idle mode. However, the desired capacity level is obtained, regardless of which of the three cylinders is operated to be in the active mode. Thus, in this case the desired capacity level can be obtained by three different setting combinations of the unloaders, i.e. the setting combination which operates a first cylinder in an active mode and a second and a third cylinder in an idle mode; the setting combination which operates the second cylinder in an active mode and the first and the third cylinder in an idle mode; and the setting combination which operates the third cylinder in an active mode and the first and the second cylinder in an idle mode.

According to the method of the invention, an effective capacity to be delivered by the reciprocating compressor is initially selected. The effective capacity could be one of the discrete capacity levels, which the compressor is capable of delivering. However, it could also be a capacity which is in between the discrete capacity levels.

Next a first sequence of capacity levels of the reciprocating compressor is selected. The first sequence provides the selected effective capacity. In the case that the effective capacity is equal to one of the discrete capacity levels, which the compressor is capable of delivering, then the first sequence only comprises this capacity level. On the other hand, in the case that the effective capacity is not equal to one of the discrete capacity levels, which the compressor is capable of delivering, then the first sequence comprises at least two of the discrete capacity levels. For instance, if the effective capacity is between two of the discrete capacity levels, the first sequence may advantageously be alternating between these two capacity levels.

For each of the capacity levels being used in the first sequence, a second sequence of setting combinations of the unloaders is selected. The setting combinations of each of the second sequences are selected from the setting combinations which obtain the corresponding capacity level. At least one of the second sequences comprises two or more setting combinations. Preferably, the second sequences comprise all of the setting combinations which obtain the corresponding capacity levels. For instance, in the example above, the capacity level of ⅓ of the maximum capacity can be reached by three different setting combinations of the unloaders. In this case a second sequence corresponding to capacity level ⅓ of the maximum capacity could be a cyclic alternation between these three setting combinations. In the case that one of the capacity levels of the first sequence is a capacity level which can only be obtained by one setting combination of the unloaders, e.g. the maximum capacity level, then the second sequence corresponding this capacity level will only comprise this setting combination.

Then a final sequence of setting combinations of the unloaders is defined, based on the first sequence of capacity levels and each of the second sequences of setting combinations of the unloaders. Thus, in the final sequence, the capacity levels obtained by the setting combinations are the capacity levels which are defined by the first sequence of capacity levels. Simultaneously, for a given capacity level the setting combinations of the unloaders, which are used for obtaining the capacity level, are alternated in accordance with the corresponding second sequence.

Finally, the reciprocating compressor is operated in accordance with the final sequence of setting combinations of the unloaders. Thus, the unloaders of the reciprocating compressor are switched between the setting combinations, in a manner which is defined by the final sequence of setting combinations of the unloaders. Thereby it is ensured that the selected effective capacity level is delivered by the compressor, due to the first sequence of capacity levels. Furthermore, it is ensured that the cylinders are evenly loaded, because the capacity levels of the first sequence of capacity levels are obtained in accordance with the second sequences of setting combinations of the unloaders, and thereby all the cylinders are switched between the active and idle modes.

The final sequence may define a cyclic switching pattern for the unloaders. In this case, each of the unloaders is switched between positions which operate the cylinders in active and idle modes, in a cyclic manner. This even further ensures that the cylinders are loaded in an even manner.

The final sequence may be defined in such a manner that when switching from one setting combination of the unloaders to another, only one of the unloaders is switched between a position providing an idle mode of the corresponding cylinder(s) and a position providing an active mode of the corresponding cylinder(s). According to this embodiment, the number of switches which each unloader must perform is minimised. This reduces the wear on the unloaders as well as on the cylinders. Furthermore, this also ensures even load of the cylinders.

The first sequence may define a cyclic switching pattern. In this case the first sequence comprises two or more capacity levels, and the first sequence switches cyclically between these two or more capacity levels.

Alternatively or additionally, the first sequence may comprise alternating between a first capacity level of the reciprocating compressor and a second capacity level of the reciprocating compressor. According to this embodiment, the first sequence comprises two capacity levels, i.e. the first capacity level and the second capacity level, and the first sequence defines that the compressor must be operated in such a manner that it alternatingly delivers refrigerant at these two capacity levels.

The first capacity level may be lower than the effective capacity to be delivered by the reciprocating compressor, and the second capacity level may be higher than the effective capacity to be delivered by the reciprocating compressor. For instance, the first and second capacity levels may be the two capacity levels which are closest to the effective capacity to be delivered by the reciprocating compressor.

For instance, the reciprocating compressor may comprise three cylinders, as described above. In the case that the selected effective capacity is 25% of the maximum capacity, it is not possible to reach the effective capacity by a single discrete capacity level, since the discrete capacity levels which the compressor is capable of delivering are zero, ⅓ of the maximum capacity, ⅔ of the maximum capacity, and the maximum capacity. The zero capacity level is too low, and the ⅓ capacity level is too high, but these two capacity levels are the ones which are closest to the selected effective capacity level. Therefore the selected effective capacity level can be obtained by switching between these two capacity levels in an appropriate manner. Therefore the first sequence could, in this case, be {0; ⅓; 0; ⅓; 0; ⅓}. It should be noted that the length of the first sequence can advantageously be selected in such a manner that the second sequences of setting combinations of the unloaders can be accommodated in the first sequence. This will be described further below.

The first sequence may define dwelling times of each of the capacity levels, the dwelling times being selected in such a manner that the selected effective capacity of the reciprocating compressor is obtained. For instance, if an effective capacity is selected, which is between two of the discrete capacity levels of the compressor, but closer to one of these capacity levels than the other, then the selected effective capacity can be obtained by operating the compressor longer at the capacity level which is closest to the selected effective capacity, than at the capacity level which is further away from the selected effective capacity. The ratio between the dwelling times of each of the capacity levels is determined by how much closer the selected effective capacity is to one of the discrete capacity levels than to the other.

The step of operating the reciprocating compressor in accordance with the final sequence may comprise alternating between the setting combinations of the unloaders at high frequency, thereby obtaining a substantially continuous range of effective capacities being obtainable. In the present context the term 'high frequency' should be interpreted to mean that the minimum time between changing the operating mode of any of the unloaders is comparable to or shorter than the typical response time of the pressures at the suction and discharge connections of the compressor or compressors in question.

The step of operating the reciprocating compressor in accordance with the final sequence may comprise operating the unloaders by forcing at least one suction valve to remain open. According to this embodiment, an unloader operates a corresponding cylinder to be in an idle mode by forcing the suction valve(s) to remain open, thereby preventing the cylinder from compressing gas. When the unloader allows the suction valve to close, the cylinder is allowed to compress gas, and is thereby in an active mode.

As an alternative, the step of operating the reciprocating compressor in accordance with the final sequence may comprise operating the unloaders by blocking a flow of gas into at least one cylinder. According to this embodiment, an unloader operates a corresponding cylinder to be in an idle mode by blocking the flow of gas into the cylinder, thereby preventing the cylinder from compressing gas. When the unloader is not blocking the flow of gas into the cylinder, the cylinder is allowed to compress gas, and is thereby in an active mode.

According to one embodiment, the invention provides a method of operating a reciprocating compressor with more than two capacity states, or setting combinations of unloaders, that periodically alternates between capacity states in such a way that a substantially continuous range of effective capacities can be obtained while the individual cylinders are evenly loaded. This method is generally beneficial but it is particularly advantageous when capacity states are alternated at high frequency.

The reciprocating compressor is part of a vapour compression system. The vapour compression system comprises at least one reciprocating compressor with more than two capacity states, further the vapour compression system comprises a control system. A reciprocating compressor with more than two capacity states comprises at least two cylinders and at least two unloaders. A cylinder can be in either idle mode or in active mode controlled by the control system, the control system controls whether a cylinder is in idle mode or in active mode by operating an unloader, each unloader operates at least one cylinder to be either in idle mode or in active mode. Each capacity state is a different combination of modes of unloaders operated in either idle mode or active mode. The control system alternates the capacity states in at least one reciprocating compressor comprising more than two capacity states periodically between different capacity states by switching the cylinders which can be operated in idle mode or in active mode between the modes in such a way that the individual cylinders which can be operated in an idle or in an active mode are evenly loaded.

Many compressor types allow stepwise control of the compressor capacity. In reciprocating compressors with more than one cylinder this can be achieved in different ways, e.g. unloading individual cylinders into idle mode by the control system forcing the suction valve to remain open or by blocking the flow of gas into the cylinder. Each cylinder can thus be operated in an idle or in an active mode. In order to unload cylinders, compressors comprise mechanisms known as unloaders. Each unloader may operate on one or more cylinders in such a way that when the unloader is operated in idle mode then the one or more cylinders on which it operates are operated in idle mode and when the unloader is operated in active mode then the one or more cylinders on which it operates are operated in active mode.

The preferred sequence of alternating capacity states in a reciprocating compressor comprising more than two capacity states may be such that in each of the state transitions only one of the unloaders changes operating mode. In some compressors, unloaders may be operated at a high frequency, meaning that the minimum time between changing the operating mode of any of the unloaders is comparable to or shorter than the typical response time of the pressures at the suction and discharge connections of the compressor or compressors in question. In practice, the minimum time between changing the operating mode of individual unloaders can be as low as a few second. Preferable the capacity states in a reciprocating compressor comprising more than two capacity states are alternated at high frequency in such a way that a substantially continuous range of effective capacities can be obtained.

A reciprocating compressor comprising more than two capacity states may comprise up to $2^n$ capacity states, where n is the number of unloaders. This represents the possible number of setting combinations of the unloaders. The individual unloaders may operate by forcing at least one suction valve to remain open. Alternatively the individual unloaders may operate by blocking the flow of gas into at least one cylinder. A reciprocating compressor of the type described above can be operated in different capacity states, depending on which unloaders are operated in the idle mode and which are operated in the active mode. Table 1 shows an example of a three unloader compressor in which each cylinder can be operated in both modes. This results in eight distinct capacity states, or setting combinations of the unloaders. In capacity state 0, all unloaders are idle and no capacity is delivered by the compressor. In capacity states 1, 2 and 4, one of the unloaders is operated in active mode and the other two unloaders are operated in idle mode, with the result that the compressor delivers one third of its maximum capacity. In capacity states 3, 5 and 6, two of the unloaders are operated in active mode and the third unloader is operated in idle mode, with the result that the compressor delivers two third of its maximum capacity. In capacity state 7, all unloaders are operated in active mode and the compressor delivers its maximum capacity. Note that this example is valid for various compressor configurations, e.g. it can be understood to refer to a three cylinder compressors with three unloaders in which each unloader operates on a single cylinder, but also to a six cylinder compressor with three unloaders in which each unloader operates on two cylinders.

TABLE 1

| Capacity State | 0 | 1 | 2 | 3 | 4 | 5 | 6 | 7 |
|---|---|---|---|---|---|---|---|---|
| Unloader1 | Idle | Idle | Idle | Idle | Active | Active | Active | Active |
| Unloader2 | Idle | Idle | Active | Active | Idle | Idle | Active | Active |
| Unloader3 | Idle | Active | Idle | Active | Idle | Active | Idle | Active |
| Capacity level | 0/3 | 1/3 | 1/3 | 2/3 | 1/3 | 2/3 | 2/3 | 3/3 |

When a compressor has multiple capacity states that correspond to the same capacity level, it is beneficial to alternate between capacity states. E.g. in order to operate the compressor from the example in table 1 at one third of its maximum capacity, it could periodically change capacity state in the order 1-2-4 and repeating this sequence. As a result, wear on moving parts will be more evenly distributed, lubrication of moving parts is better controlled, and collection of oil in cylinders that run too long in idle mode is avoided. The compressor may therefore be expected to have a longer life-time, and the mean time between failures may be expected to be longer.

Effective capacities other than the discrete values available in the different compressor capacity states can be obtained by periodically alternating between capacity states with different capacities. Here the effective capacity must be understood as the delivered capacity, averaged over the duration of a staging sequence, while the time in which the compressor is operated in a particular capacity state is comparable to or shorter than the typical response time of the pressures at the suction and discharge connections of the compressor or compressors.

Compressors of the type described have many applications. Typical examples are vapour compression systems such as refrigeration systems, air conditioning systems and heat pumps.

BRIEF DESCRIPTION OF THE DRAWINGS

The invention will now be described in further detail with reference to the accompanying drawings in which.

DETAILED DESCRIPTION

Figure 1:
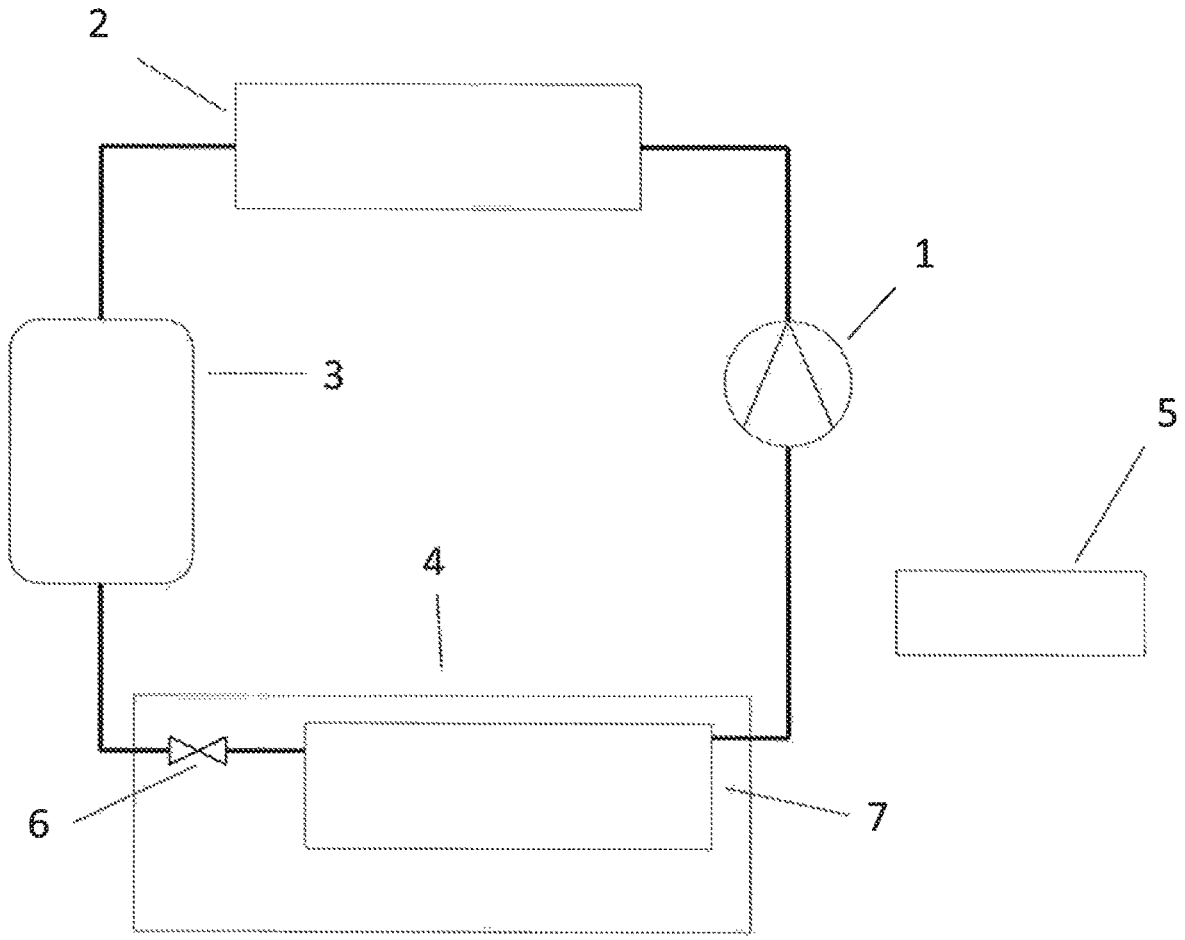
FIG. 1 is a configuration of a refrigeration system, on which the method of this invention can be applied.

FIG. 1 shows a common configuration of a refrigeration system, including one or more compressors 1, a heat rejecting heat exchanger 2, a receiver 3, one or more consumers 4 and a control system 5. The one or more consumers 4 can, e.g., be display cases or cold rooms and incorporate one or more evaporators 7 and one or more expansion devices 6. The one or more compressors 1 extract gaseous refrigerant from the one or more consumers 4 and delivers this refrigerant at a higher pressure and temperature to the heat rejecting heat exchanger 2, in which the refrigerant is condensed into liquid. The liquid refrigerant then flows into the receiver 3, from which it re-enters the one or more consumers 4 through the one or more expansion devices 6, after which the refrigerant is evaporated in the one or more evaporators 7. The control system 5 monitors one or more parameters of the system and determines, among other things, the required capacity of each of the one or more compressors 1, in order to maintain optimal values of the one or more parameters. These one or more parameters may include, among others, the refrigerant pressure inside the one or more evaporators 7, a suitable temperature inside the one or more consumers 4 and the air humidity inside the one or more consumers 4.

Figure 2A:
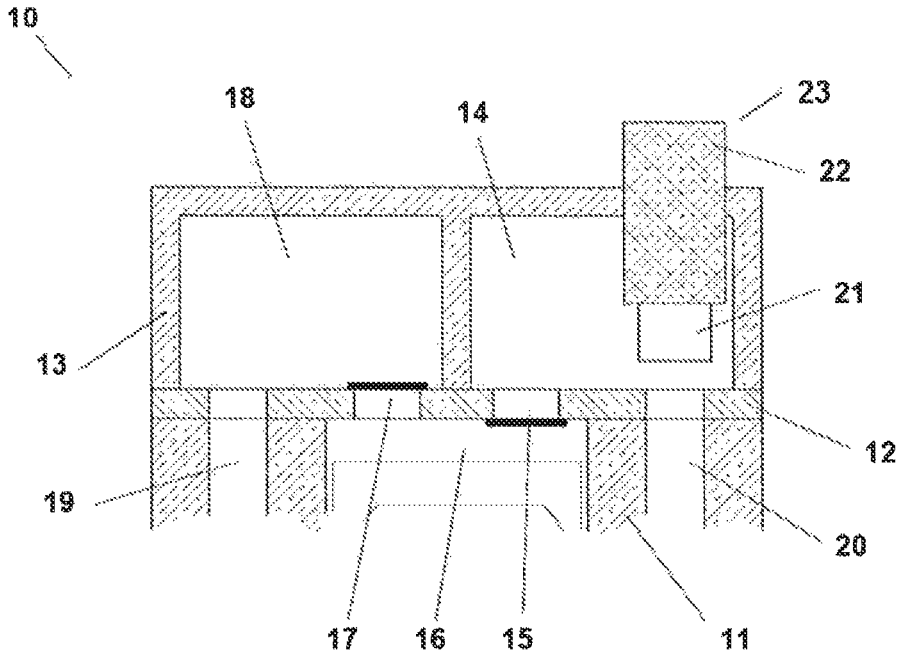
FIGS. 2*a* and 2*b* illustrate a method by which unloaders may be incorporated into a reciprocating compressor.
Figure 2B:
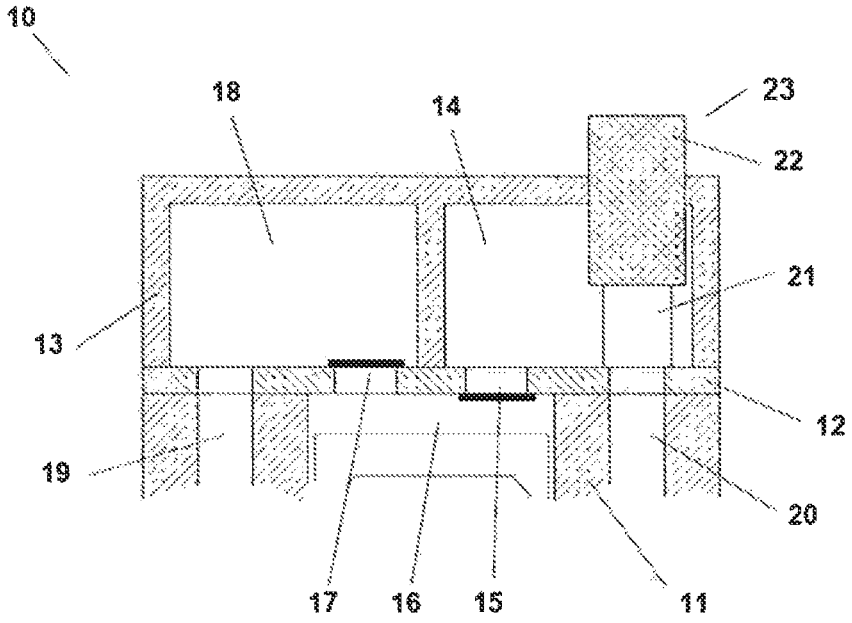

FIGS. 2*a* and 2*b* show two sketches of a cylinder head assembly 10 comprising an unloader 23. The gaseous refrigerant enters the cylinder head 13 through a first bore hole 20 through the compressor housing 11, and through the valve plate 12 that leads to the suction plenum 14. From the suction plenum 14 the refrigerant passes through the suction valve 15 into the cylinder 16 and, after being compressed, it flows out of the cylinder 16 into the discharge plenum 18, through the discharge valve 17. Finally, the refrigerant leaves the cylinder head assembly 10 through a second bore hole 19 through the valve plate 12 and through the compressor housing 11.

The unloader 23 mechanism consists of a plunger 21 and an actuator 22. This plunger 21 can be retracted by the actuator 22, as shown in FIG. 2*a*, thereby allowing refrigerant to flow into the suction plenum 14. This corresponds to the active mode of the unloader 23. The plunger 21 can also be extended by the actuator 22, as shown in FIG. 2*b*, such that it blocks the flow of refrigerant into the suction plenum 14, and therefore into the cylinder 16. This corresponds to the idle mode of the unloader 23. Retraction and extension of the plunger 21 by the actuator 22 is typically controlled by an electrical signal from a controller 5.

Returning to the example of table 1, effective capacities between zero and one third of the maximum capacity can, e.g., be obtained by periodically changing the capacity state in the order 0-1-0-2-0-4, and repeating this sequence. In this case, the first sequence of capacity levels could be regarded as {0; ⅓; 0; ⅓; 0; ⅓}. The second sequence of setting combinations of the unloaders, or capacity states, corresponding to the zero capacity level could be regarded as {0; 0; 0}. The second sequence of setting combinations of the unloaders, or capacity states, corresponding to the ⅓ capacity level could be regarded as {1; 2; 4}. The first sequence of capacity levels is merged with the second sequences of setting combinations of the unloaders in such a manner that the first sequence is followed, and each time a zero capacity level is needed, the second sequence corresponding to the zero capacity level is followed, and each time a ⅓ capacity level is needed, the second sequence corresponding to the ⅓ capacity level is followed. Thereby the final sequence of setting combinations of the unloaders, {0; 1; 0; 2; 0; 4} is obtained.

Effective capacities between one third and two third of the maximum capacity can, e.g., be obtained by periodically changing the capacity state in the order 1-3-2-6-4-5, and repeating this sequence. In this case, the first sequence of capacity levels could be regarded as {⅓; ⅔; ⅓; ⅔; ⅓; ⅔}. The second sequence of setting combinations of the unloaders, or capacity states, corresponding to the ⅓ capacity level could be regarded as {1; 2; 4}. The second sequence of setting combinations of the unloaders, or capacity states, corresponding to the ⅔ capacity level could be regarded as {3; 6; 5}. Merging the first sequence of capacity levels with the second sequences of setting combinations of the unloaders, in the manner described above, results in the final sequence of setting combinations of the unloaders, {1; 3; 2; 6; 4; 5}.

Effective capacities between two third of the maximum capacity and maximum capacity can, e.g., be obtained by periodically changing the capacity state in the order 3-7-5-7-6-7, and repeating this sequence. In this case, the first sequence of capacity levels could be regarded as {⅔; 1; ⅔; 1; ⅔; 1}. The second sequence of setting combinations of the unloaders, or capacity states, corresponding to the ⅔ capacity level could be regarded as {3; 5; 6}. The second sequence of setting combinations of the unloaders, or capacity states, corresponding to the maximum capacity level could be regarded as {7; 7; 7}. Merging the first sequence of capacity levels with the second sequences of setting combinations of the unloaders, in the manner described above, results in the final sequence of setting combinations of the unloaders, {3; 7; 5; 7; 6; 7}.

It is noted that other sequences that yield the same effective capacity ranges are also possible. It is also noted that all final sequences presented in the paragraphs above share the feature that each individual state transition changes the operating mode of only one unloader. Finally, it is noted that, for all final sequences presented in the paragraphs above, the distribution between the idle mode and the active mode is the same across all unloaders, and therefore the same across all cylinders.

By varying the period of time in which a compressor is operated in a particular capacity state, any effective capacity can be obtained. Returning to the example of table 1, eight ninth of the maximum capacity can be obtained by alternating between capacity states corresponding to two third of the maximum capacity and the capacity state corresponding to the maximum capacity, while the contribution to the effective capacity of the capacity states that correspond to two third of the maximum capacity is half of the contribution to the effective capacity of the capacity state that correspond to full capacity. In other words, that the compressor is operated twice as long at its maximum capacity than it is operated at two third of its maximum capacity. An example of such a sequence is illustrated in table 2.

TABLE 2

| Capacity state | 3 | 7 | 5 | 7 | 6 | 7 |
|---|---|---|---|---|---|---|
| Duration in second | 5 | 10 | 7 | 14 | 6 | 12 |
| Capacity level | 2/3 | 3/3 | 2/3 | 3/3 | 2/3 | 3/3 |

It is noted that, in this example, even more evenly distributed load across the cylinders can be achieved when the duration in which the compressor operates in states 3, 5 and 6 are equalized. E.g. when the compressors operate for five second in states 3, 5 and 6, and for three times ten second in state 7.

It is also noted that, in this example, the compressor capacity changes six times during this sequence while each individual unloader, and therefore each individual cylinder, only changes operating mode twice. Since compressor manufacturers often pose minimum limits to the time between changing the operating mode of individual unloaders, this feature implies that the frequency at which the compressor capacity changes can be significantly higher than the maximum frequency at which individual unloaders may be operated. This helps to reduce pressure variations resulting from capacity changes.

Some compressors only allow part of the cylinders to operate both in idle mode as well as in active mode while the remaining cylinders can only be operated in active mode. Table 3 shows an example of a four cylinder compressor with two unloaders, in which each unloader operates on a single cylinder. Such a compressor is capable of operating on half of its maximum capacity, at three quarters of its maximum capacity or at its maximum capacity. When operated at three quarters of it maximum capacity, a controller for such a compressor can achieve evenly distributed load across those cylinders that can be operated in idle mode or in active mode by changing capacity state in the order 1-2, and repeating this sequence. Any effective capacity between half of the maximum capacity and three quarters of the maximum capacity can be achieved by changing the capacity state in the order 0-1-0-2, and repeating this sequence. Any effective capacity between three quarters of the maximum capacity and the maximum capacity can be achieved by changing the capacity state in the order 1-3-2-3, and repeating this sequence. Thus, a substantially continuous range from half of the maximum capacity to the maximum capacity can be achieved.

TABLE 3

| | Capacity state | | | |
|---|---|---|---|---|
| | 0 | 1 | 2 | 3 |
| Unloader1 | Idle | Idle | Active | Active |
| Unloader2 | Idle | Active | Idle | Active |
| Capacity level | 2/4 | 3/4 | 3/4 | 4/4 |

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method of operating a reciprocating compressor defining two or more capacity levels, the reciprocating compressor comprising a plurality of cylinders and a plurality of unloaders, each unloader having settings for operating at least one of the cylinders in an idle mode or in an active mode, wherein at least some of the capacity levels of the reciprocating compressor are obtainable by two or more combinations of unloader settings, the method comprising the steps of:

selecting, by a controller, an effective capacity to be delivered by the reciprocating compressor, selecting, by the controller, a first sequence of capacity levels of the reciprocating compressor for providing the selected effective capacity, for each capacity level in the first sequence, selecting, by the controller, a second sequence of unloader settings for obtaining the capacity level, at least one of said second sequences comprising two or more different combinations of the plurality of unloaders being set to an idle mode or active mode to obtain the capacity level, defining, by the controller, a final sequence of setting combinations of the unloaders, based on the first sequence of capacity levels and each of the second sequences of setting combinations of the unloaders, in such a manner that:

the capacity levels provided by the setting combinations of the final sequence provides the capacity levels of the first sequence of capacity levels, and for each of the capacity levels of the first sequence of capacity levels, the final sequence provides the setting combinations of the corresponding second sequence of setting combinations of the unloaders, and operating, by the controller, the reciprocating compressor in accordance with the final sequence; and wherein the controller selects the second sequence of unloader settings and defines the final sequence of setting combinations of the unloaders so that a load is evenly distributed across the plurality of cylinders during the operating of the reciprocating compressor; and wherein, during the final sequence, a frequency at which the capacity levels change is greater than a frequency at which individual unloaders shift between the idle and active modes.

2. The method according to claim 1, wherein the final sequence defines a cyclic switching pattern for the unloaders.

3. The method according to claim 1, wherein the final sequence is defined in such a manner that when switching from one setting combination of the unloaders to another, only one of the unloaders is switched between a position providing an idle mode of the corresponding cylinder(s) and a position providing an active mode of the corresponding cylinder(s).

4. The method according to claim 1, wherein the first sequence defines a cyclic switching pattern.

5. The method according to claim 1, wherein the first sequence comprises alternating between a first capacity level of the reciprocating compressor and a second capacity level of the reciprocating compressor.

6. The method according to claim 5, wherein the first capacity level is lower than the effective capacity to be delivered by the reciprocating compressor, and the second capacity level is higher than the effective capacity to be delivered by the reciprocating compressor.

7. The method according to claim 1, wherein the first sequence defines dwelling times of each of the capacity levels, the dwelling times being selected in such a manner that the selected effective capacity of the reciprocating compressor is obtained.

8. The method according to claim 1, wherein the step of operating the reciprocating compressor in accordance with the final sequence comprises alternating between the setting combinations of the unloaders at high frequency, thereby obtaining a substantially continuous range of effective capacities being obtainable.

9. The method according to claim 1, wherein the step of operating the reciprocating compressor in accordance with the final sequence comprises operating the unloaders by forcing at least one suction valve to remain open.

10. The method according to claim 1, wherein the step of operating the reciprocating compressor in accordance with the final sequence comprises operating the unloaders by blocking a flow of gas into at least one cylinder.

11. The method according to claim 2, wherein the final sequence is defined in such a manner that when switching from one setting combination of the unloaders to another, only one of the unloaders is switched between a position providing an idle mode of the corresponding cylinder(s) and a position providing an active mode of the corresponding cylinder(s).

12. The method according to claim 2, wherein the first sequence defines a cyclic switching pattern.

13. The method according to claim 3, wherein the first sequence defines a cyclic switching pattern.

14. The method according to claim 2, wherein the first sequence comprises alternating between a first capacity level of the reciprocating compressor and a second capacity level of the reciprocating compressor.

15. The method according to claim 3, wherein the first sequence comprises alternating between a first capacity level of the reciprocating compressor and a second capacity level of the reciprocating compressor.

16. The method according to claim 4, wherein the first sequence comprises alternating between a first capacity level of the reciprocating compressor and a second capacity level of the reciprocating compressor.

17. The method according to claim 2, wherein the first sequence defines dwelling times of each of the capacity levels, the dwelling times being selected in such a manner that the selected effective capacity of the reciprocating compressor is obtained.

18. The method according to claim 3, wherein the first sequence defines dwelling times of each of the capacity levels, the dwelling times being selected in such a manner that the selected effective capacity of the reciprocating compressor is obtained.

19. The method according to claim 4, wherein the first sequence defines dwelling times of each of the capacity levels, the dwelling times being selected in such a manner that the selected effective capacity of the reciprocating compressor is obtained.

20. The method according to claim 5, wherein the first sequence defines dwelling times of each of the capacity levels, the dwelling times being selected in such a manner that the selected effective capacity of the reciprocating compressor is obtained.

21. The method according to claim 1, wherein the defining, by the controller, the final sequence comprises merging the first sequence of capacity levels with the second sequence of unloader settings in such a manner that the first sequence is followed, and each time a particular capacity level of the first sequence of capacity levels is needed, the corresponding second sequence of setting combinations of the unloaders for the particular capacity level is followed.

* * * * *